United States Patent [19]

Hart et al.

[11] Patent Number: 4,632,260

[45] Date of Patent: Dec. 30, 1986

[54] ASSEMBLABLE PANEL FOR A RACK

[75] Inventors: John P. Hart, Lakewood; John D. Krummell, Irvine, both of Calif.

[73] Assignee: John D. Krummell, Irvine, Calif.

[21] Appl. No.: 607,143

[22] Filed: May 4, 1984

[51] Int. Cl.[4] ..... A47F 5/00

[52] U.S. Cl. ..... 211/189; 52/588; 211/87

[58] Field of Search ..... 211/189, 186, 87, 90; 52/588, 36, 522; 248/222.2, 222.3, 220.2, 73

[56] References Cited

U.S. PATENT DOCUMENTS

| | | | |
|---|---|---|---|
| 2,944,676 | 7/1960 | Bell | 211/191 |
| 3,085,367 | 4/1963 | De Ridder et al. | 52/588 X |
| 3,625,372 | 12/1971 | MacKenzie | 211/191 |
| 3,969,866 | 7/1976 | Kyne | 52/588 |
| 4,420,087 | 12/1983 | Johns | 211/189 |
| 4,450,970 | 5/1984 | Shepherd | 211/189 |

FOREIGN PATENT DOCUMENTS

| | | | |
|---|---|---|---|
| 257361 | 9/1961 | Australia | 52/588 |

*Primary Examiner*—Robert W. Gibson, Jr.
*Attorney, Agent, or Firm*—Lyon & Lyon

[57] ABSTRACT

An assemblable panel for an open rack having a plurality of load strips and slats which interengage with each other to enclose a side of the rack. Two embodiments allow individual slats to be removed from the assembled panel to facilitate adjustment of the horizontal load members of the rack or replacement of individual strips or slats. Means are provided to compensate for differing tolerances of different manufacturers of racks. Ribs are formed in the strips and slats to provide rigidity and stability and increase the impact resistance of the assembled panel.

11 Claims, 5 Drawing Figures

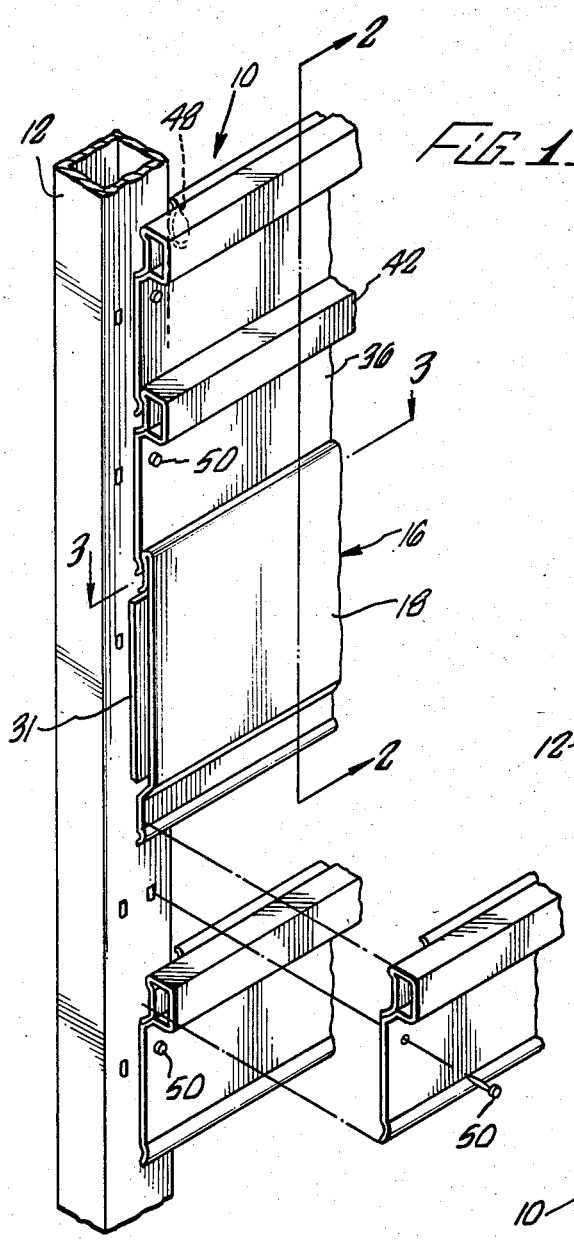
FIG. 1
FIG. 2
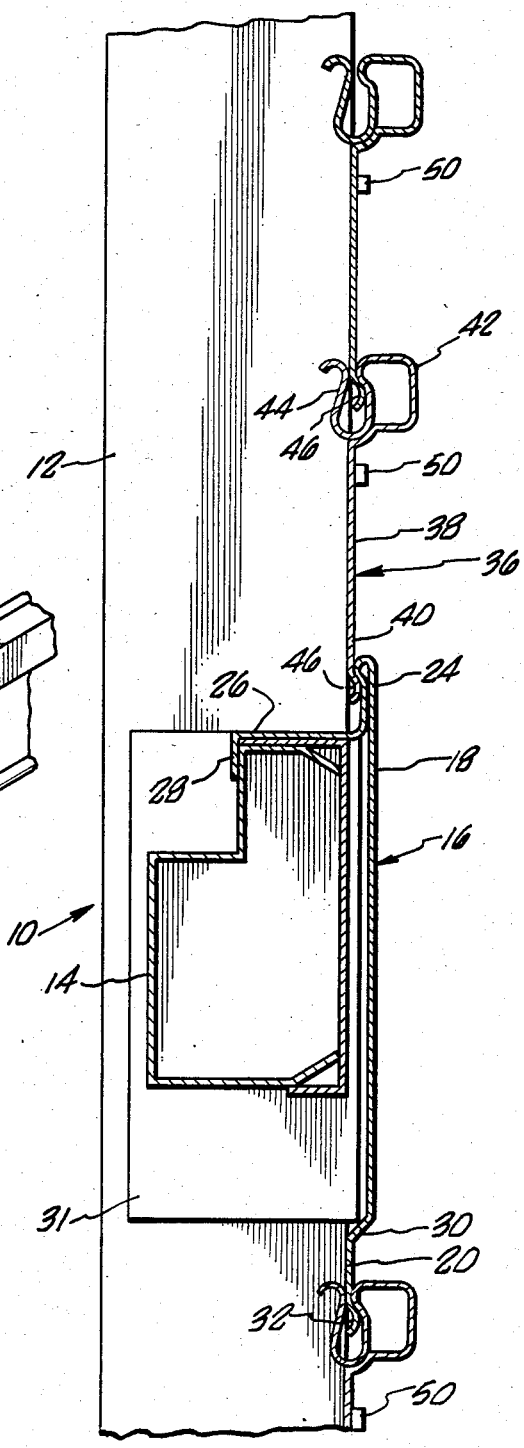
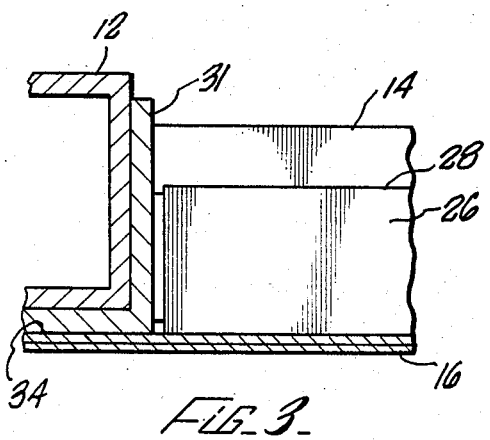
FIG. 3

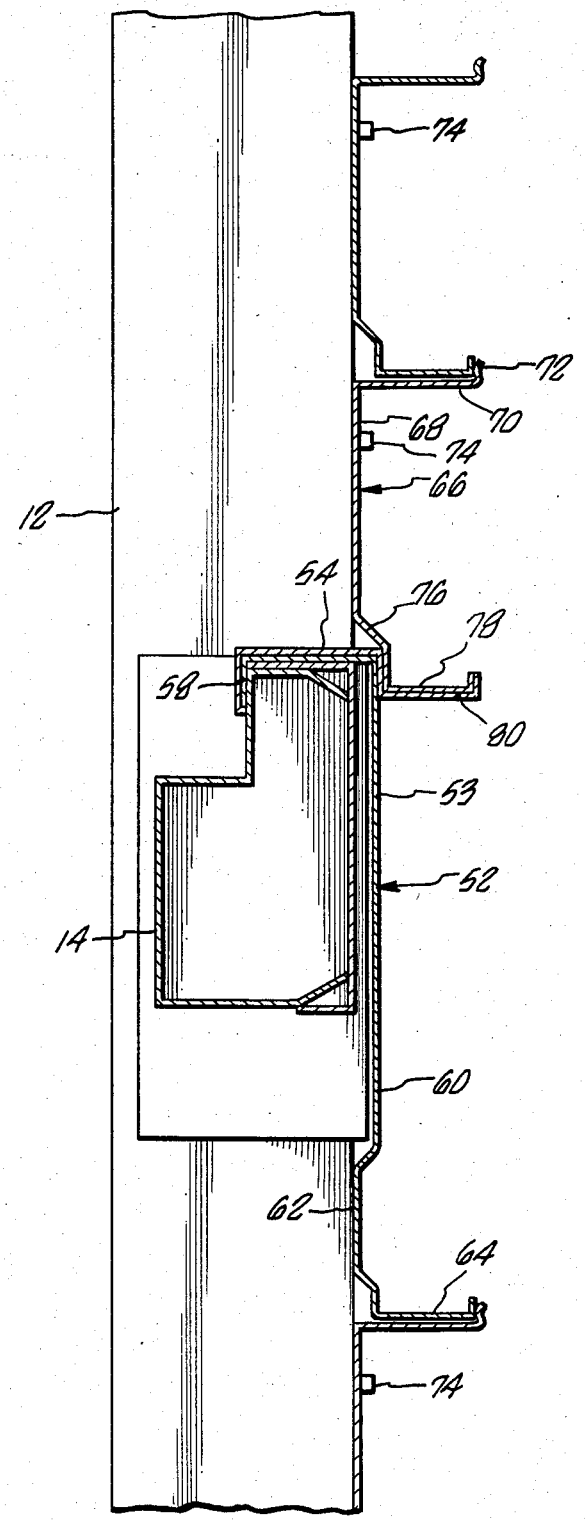
FIG. 4.
FIG. 5.
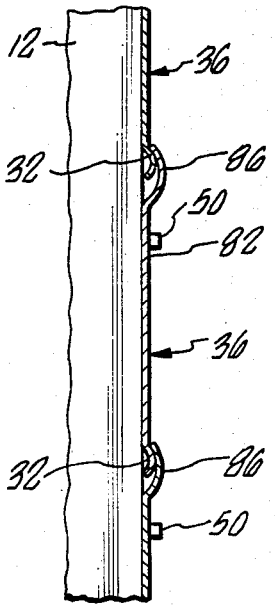

ASSEMBLABLE PANEL FOR A RACK

BACKGROUND OF THE INVENTION

The use of large storage warehouses is a common occurrence in order to maintain an adequate inventory of necessary products or to insure convenient distribution of products to outlying areas from a centralized manufacturer. Typically, a warehouse will contain a large number of racks situated back to back and arranged in rows. Goods are then stored on the racks until a time when they are needed and may be conveniently retrieved.

Such configurations of racks pose an extreme fire hazard since open racks tend to act as chimneys for a fire which starts near the base of the rack. This chimney effect acts to promote the spreading of a fire and the destruction of the warehouse and everything within the warehouse. In addition, it is desirable to have a means to prevent goods from one rack from being inadvertently mixed with goods on an adjacent rack or from falling off the back of the rack into the small space between adjacent racks.

In order to limit these problems, some warehouse owners have attached solid pieces of sheet metal to the back of the racks through means such as riveting, welding or by other means. These solutions are unsatisfactory because of the limited flexibility they provide. In order to change the level of a horizontal shelf of a rack with a permanently attached back panel, it is necessary to detach the entire back panel or to expend a great number of hours to have the rack shelf disassembled and moved to its new position.

Any panel which acts as a back for a rack must therefore be flexible in its means of attachment to the rack. It is also desirable to make such panels impact resistant so as to prevent damage to the panel due to minor bumps received when heavy packages are moved.

SUMMARY OF THE INVENTION

The invention contemplates the use of a series of interlocking strips and slats. Each piece may be attached to the vertical members of the rack and engaged with the adjacent piece. The assembled pieces will form a solid panel on either the front or the back of the rack to effectively enclose the rack on one side, thereby preventing objects from falling off that side of the rack and inhibiting the chimney effect of open racks by limiting the free passage of air.

Therefore it is an object of the present invention to provide an assemblable panel which may be conveniently attached to one side of a rack thereby enclosing the rack and preventing items from falling off that side of the rack.

It is a further object of the invention to provide an assemblable panel which will effectively inhibit the chimney effect of open racks.

It is a further object of the invention to provide an assemblable panel for a rack which may be conveniently assembled and disassembled without bulky and expensive tools.

It is a further object of the invention to provide an assemblable panel to permit adjustment of the horizontal rack load beams and shelves.

It is a further object of the invention to provide an assemblable panel for a rack which will resist normal impacts without permanent deformation. Other and more detailed objects of the invention will become apparent upon examination of specification and drawings contained herein.

DESCRIPTION OF THE DRAWINGS

FIG. 1 is an exploded perspective view of several strips and slats of the preferred embodiment of the invention;

FIG. 2 is a cross-sectional view taken substantially along lines 2—2 of FIG. 1 of several of the strips and slats of the preferred embodiment of the invention;

FIG. 3 is a cross-sectional view taken substantially along line 3—3 of FIG. 1;

FIG. 4 is a cross-sectional view of a second embodiment of the invention; and

FIG. 5 is a cross-sectional view of a third embodiment of the invention.

DETAILED DESCRIPTION OF THE INVENTION

As shown in FIGS. 1–3, a rack 10 typically has vertical members 12 and horizontal loading members 14 which support the not-shown shelves. In the preferred embodiment of the invention, a plurality of load strips 16 have an upper portion 18 and a lower portion 20. The upper portion 18 of each load strip 16 is formed with a vertical protrusion 24 and a horizontal extension 26. The horizontal extension 26 has a lip portion 28 formed at its end. The horizontal extension 26 acts to engage a corresponding horizontal member 14 of the rack 10 so as to provide support for the assembled panel.

A first rib 30 is formed at the junction of the upper portion 18 and the lower portion 20 of the load strip 16. The lower portion 20 acts as a bearing pad to rest against the vertical members 12 to provide additional rigidity. A second rib 32 is formed at the lower edge of the lower portion 20 of the load strip 16. A notch 34 is formed at each end of the horizontal extension 26 so as to accommodate the vertical members 12 of the rack 10. The ribs 30 and 32 act to provide rigidity and strength to the load strips and to provide increased impact resistance. The first rib 30 also provides clearance for the connection brackets 31 of the horizontal load member 14.

A plurality of slats 36 having an upper portion 38 and a lower portion 40 may interconnect with each other or the load strips 16. The slats 36 have a box-like support member 42 and a clip portion 44 at the upper end of the upper portion 38. The support member 42 gives the upper portion 38 of the slats 36 rigidity and stability and increases its impact resistance. The clip portion 44 is substantially U shaped and formed such that the upper ends of the U are compressed together. The lower portion 40 of the slats 36 also has a rib 46 therein to provide stability, rigidity and increased impact resistance. The clip portion 44 of the slat 36 has notches 48 in each end to accommodate the vertical members 12 of the rack 10. Means such as prongs 50 are used to attach the slats 36 to the vertical members 12 of the rack 10. Prongs, clips, lanced hooks or other connecting devices are used to attach the slats 36 to the vertical members 12 through the existing holes or slots in the vertical members 12 of rack 10. Various attachment methods are contemplated because the size, shape and location of existing holes and slots in vertical members 12 vary from manufacturer to manufacturer.

FIG. 4 shows a second embodiment of the invention. The upper portion 53 of the load strip 52 has a horizontal extension 54. A not shown vertical protrusion may be formed thereon to provide additional clearance if necessary. A lip portion 58 is formed at the end of the horizontal extension 54. The lower portion 60 of the load strip 52 has a bearing pad 62 formed thereon. An engagement clip 64 is formed on the end of the lower portion 60 of the load strip 52.

The upper portion 68 of the slat 66 has a horizontal extension 70 and a vertical engagement protrusion 72. In the preferred embodiment, the vertical engagement protrusion 72 is formed substantially in the shape of a truncated S but other shapes are possible. Means such as prongs 74 are used to connect the slats 66 to the existing holes in the vertical members 12 of the rack 10. The lower portion 76 of the slat 66 has a recessed engagement clip 78 formed thereon. Means such as a clip 80 is used to secure the recessed engagement clip 78 on the lower portion 68 of the slat 66 to the upper portion 53 of the load strip 52.

A third embodiment of the invention is shown in FIG. 5. The third embodiment is constructed such that the upper portion 82 of the slat 36 has an upper rib 86 at its upper end. The remaining details of the third embodiment are sufficiently similar to the first embodiment that they will not be described again. When assembled, the upper rib 86 of the slat 36 acts to overlap the above-adjacent rib 32 and 46 of a load strip 16 or slat 36, respectively.

Having fully described the structure of the invention its use and operation will be described hereinbelow. To assemble a panel for a rack, starting from the bottom of the rack, slats and load strips are successively attached to the vertical members of the rack. From just above the bottom horizontal load member, slats are successively attached to the vertical members up to the point corresponding to the next horizontal load member. At this point a load strip is used and the process is continued to the top of the rack.

To assemble the preferred embodiment, the rib 46 of a slat 36 is fitted between the vertical protrusion 24 of the load strip 16 and the vertical member 12 of the rack 10 and the slat is attached to the vertical members 12. This acts to retain the slat 36 in its assembled position. The rib 46 of the next slat 36 is fitted within the clip portion 44 of the attached slat 36. At the position corresponding to the next intermittent horizontal support member 14, the second rib 32 of a load strip 16 is engaged with the clip portion 44 of the beneath-adjacent slat 36 prior to engaging the upper portion 18 of the load strip 16. This process is repeated until the entire panel is assembled on the desired side of the rack 10.

If it is desired to remove a portion of the panel, the slats 36 are formed such that upon disengagement of a slat 36 from the vertical members 12 of the rack 10, it may be slid upwards to a point where the lower portion 40 of the removed slat 36 will clear the clip portion 44 of the below-adjacent piece. The clip portion 44 of the removed slat 36 may then be removed from the lower portion 40 of the above-adjacent piece. This enables individual slats to be removed from an assembed panel to facilitate adjustment of the horizontal load members 14 or replacement of a slat 36 or a strip 16 due to damage or the like. This also allows flexibility in the fitting of pieces to compensate for different tolerances of different manufacturers.

Assembly of the second embodiment of the invention is similar to that of the first. Slats 66 are successively attached from a position immediately above the bottom horizontal member 14 of the rack 10 up to the position corresponding to the next horizontal load member 14. At the position corresponding to the next horizontal load member 14, a load strip 62 is attached to the rack 10 such that the engagement clip 64 is retained by the vertical protrusion 72 of the beneath-adjacent slat 66. The bearing pad 62 of the load strip 52 rests against the vertical members 12 of the rack 10 at each end and provides additional rigidity to the assembled panel. A slat 66 is attached to the vertical member 12 such that the recessed engagement clip 78 is in contact with the vertical protrusion 56 of the load strip 52. Additional slats 66 are attached such that the recessed engagement clip 78 on the bottom of the slat 66 is retained by the truncated vertical protrusion 72 on the upper portion 68 of the beneath-adjacent slat 66. This process is continued to the top of the rack wherein the panel will be fully assembled.

Assembly of the third embodiment is similar to that of the first embodiment except the upper rib 86 of the slats 36 merely overlaps the above-adjacent piece lower rib rather than having actual inter-engagement through a clip portion 44.

Due to the nature of the configuration of the slats and load strips, a slight gap is provided between each slat and strip to allow the assemblable panel to be used with racks of different manufacturers having different tolerances.

The preferred embodiments of the invention have been described herein for purposes of example only and should not be construed to limit the scope of the invention beyond those set forth in the appended claims.

We claim:

1. A rack having a plurality of vertical members and horizontal members, assemblable means to enclose at least one side of said rack, said assemblable means including the plurality of interlocking pieces which may be selectively assembled into a panel of different sizes depending on the needs of the user, said interlocking pieces including means for engaging at least one of said interlocking pieces with each said horizontal member, and means to removably attach said interlocking pieces to said rack.

2. An assemblable panel for a rack having vertical members and horizontal members, comprising, a plurality of load strips having an upper portion and a lower portion, means to engage said load strip upper portion with a horizontal member, a plurality of slats having an upper portion and a lower portion, means to engage said upper portion of a strip with said lower portion of a slat, means to interengage said lower portion of a strip with said upper portion of a slat, means to interengage said lower portion of a slat with said upper portion of a slat and means to attach said slat and said strips to the vertical members.

3. An assemblable panel for a rack having vertical members and horizontal members, comprising, a plurality of load strips having an upper portion and a lower portion, said upper portion being formed so as to have a vertical protrusion and a horizontal extension extending therefrom, said horizontal extension having a lip formed at its end, said lower portion having a rib formed therein, a plurality of slats having an upper portion and a lower portion, said upper portion including a clip portion, and means to attach said slats and strips to the vertical members, said slats and strips being successively arranged in an assembled panel such that said load strips are attached to the rack at positions corresponding to the rack horizontal members, and said slats are successively interengaged between said load strips.

4. The assemblable panel as set forth in claim 3 wherein said clip portion has a support member which is substantially box shaped and a clip member which is substantially U shaped.

5. The assemblable panel as set forth in claim 4 wherein said slats and said strips have notches formed therein to accommodate the vertical members.

6. An assemblable panel as set forth in claim 3 wherein said upper portion of each said load strip is interengaged with said lower portion of said adjacent slat, said lower portion of each said load strip is interengaged with said upper portion of said adjacent slat and said upper portion of each said successively arranged slat is interengaged with said lower portion of an adjacent successively arranged slat.

7. An assemblable panel for a rack having vertical members and intermittent horizontal members, comprising, a plurality of load strips having an upper portion and a lower portion, said upper portion being formed so as to engage the horizontal members, said lower portion having a bearing pad and an engagement clip, a plurality of slats having an upper portion and a lower portion, said upper portion of said slats having a horizontal portion and a vertical protrusion, said lower portion of said slats having a recessed clip portion formed thereon, means to connect said slats and said load strips to the vertical members, said slats and said strips being arranged in an assembled panel such that said load strips are attached to the rack at positions corresponding to the rack horizontal members said slats being successively interengaged between said load strips, and clip means to interengage said upper portion of each said load strip with said lower portion of said adjacent slat.

8. The assemblable panel as set forth in claim 7 wherein said slats and strips have notches formed therein to accommodate the vertical members.

9. An assemblable panel as set forth in claim 7 wherein said lower portion of each said load strip is interengaged with said upper portion of said adjacent slat and said slats are successively interengaged by interengaging said upper portion of each said slat with said lower portion of said adjacent slat.

10. A rack having a plurality of vertical members and at least one horizontal member, an assemblable panel means including a plurality of load strips having an upper portion and a lower portion, said upper portion being formed so as to have a vertical protrusion and a horizontal extension extending therefrom, said horizontal extension having a lip formed at its end, said lower portion having a rib formed therein, a plurality of slats having an upper portion and a lower portion, said upper portion including a clip portion, and means to attach said slats and strips to said rack vertical members, said slats and strips being arranged in an assembled panel such that said load strips are attached to said rack at positions corresponding to each said rack horizontal member and said slats are successively interengaged between said load strips.

11. A rack having a plurality of vertical members and intermittent horizontal members, an assemblable panel means to enclose at least one side of said rack, said assemblable means including a plurality of load strips having an upper portion and a lower portion, said upper portion being formed so as to engage said rack horizontal members, said lower portion having a bearing pad and an engagement clip, a plurality of slats having an upper portion and a lower portion, said upper portion of said slats having a horizontal portion and a vertical protrusion, said lower portion of said slats having a recessed clip portion formed thereon, means to connect said slats and said load strips to said vertical members, said slats and said strips being arranged in an assembled panel such that said load strips are attached to said rack at postions corresponding to said rack horizontal members, said slats being successively interengaged between said load strips, and clip means to interengage said upper portion of each said load strip with said lower portion of said adjacent slat.

* * * * *